US006095626A

United States Patent [19]

Lautenschläger

[11] Patent Number: 6,095,626

[45] Date of Patent: Aug. 1, 2000

[54] SUBSURFACE PULLOUT GUIDE FOR DRAWERS, ETC.

[75] Inventor: Horst Lautenschläger, Reinheim, Germany

[73] Assignee: MEPLA-Werke Lautenschläger GmbH & Co. KG, Germany

[21] Appl. No.: 09/077,353

[22] PCT Filed: Nov. 13, 1996

[86] PCT No.: PCT/EP96/04953

§ 371 Date: Sep. 17, 1998

§ 102(e) Date: Sep. 17, 1998

[87] PCT Pub. No.: WO97/18732

PCT Pub. Date: May 29, 1997

[30] Foreign Application Priority Data

| | | | |
|---|---|---|---|
| Nov. 23, 1995 | [DE] | Germany | 195 43 587 |
| Dec. 22, 1995 | [DE] | Germany | 195 47 931 |
| Jan. 15, 1996 | [DE] | Germany | 196 01 183 |
| Aug. 17, 1996 | [DE] | Germany | 196 33 241 |

[51] Int. Cl.[7] ..... A47B 88/04

[52] U.S. Cl. ..... 312/334.1; 312/334.28

[58] Field of Search ..... 312/332, 334.1, 312/334.2, 334.14, 334.22, 334.44, 334.45, 350; 384/23, 19

[56] References Cited

U.S. PATENT DOCUMENTS

| | | |
|---|---|---|
| 3,836,223 | 9/1974 | Signore . |
| 4,728,200 | 3/1988 | Röck . |
| 4,779,999 | 10/1988 | Lautenschläger . |

FOREIGN PATENT DOCUMENTS

| | | |
|---|---|---|
| 2946113 | 5/1981 | Germany . |
| 8900914 | 4/1989 | Germany . |
| 4027468 | 3/1992 | Germany . |
| 4123311 | 1/1993 | Germany . |
| 4123312 | 1/1993 | Germany . |
| 195282 | 5/1938 | Switzerland . |
| 240433 | 4/1946 | Switzerland . |

*Primary Examiner*—Peter M. Cuomo
*Assistant Examiner*—Jerry A. Anderson
*Attorney, Agent, or Firm*—Londa & Gluck LLP

[57] ABSTRACT

A subsurface pullout guide (10) with a guiding rail (12), constructed as a profiled rail, which is to be fastened to the carcass wall, and with a running rail (26), which is disposed in the region of the bottom of the drawer and supported longitudinally displaceably on the guiding rail by rolling bodies (20, 22), which are held in a cage (24). A hollow profiled section, the cross section of which is identical with that of the running rail (26), is hinged to the end of the running rail (26) within the carcass so that it can be swiveled from a first position, aligned with the running rail and directly adjoining its end within the carcass, into a second position, which extends, on the other hand, essentially parallel to the rear wall of the drawer. Interacting guiding means are provided at the guiding rail and the pivotable hollow profiled section, which swivel the hollow profiled section (30) during the shifting of the running rail (26) on the guiding rail (12) from the end position, assigned to the completely pulled out position of the drawer, in the direction in which the drawer is pushed in, as its end in the carcass approaches the rear wall of the carcass, increasingly into the second position, which is essentially parallel to the rear wall of the drawer.

34 Claims, 3 Drawing Sheets

10
12
14
16
18
20
22
24
26
28
30
32
34
34a
35
36
38
5

SUBSURFACE PULLOUT GUIDE FOR DRAWERS, ETC.

BACKGROUND OF THE INVENTION

The invention relates to a subsurface pullout guide for drawers or the like, which are supported in the carcass of a cupboard, wardrobe or cabinet and can be pulled out. The guiding rail of the pullout guide, constructed as a profiled rail and fastened to the wall of the carcass, engages from below the associated running rail, which is formed by a hollow profiled rail open at the underside and disposed in the region of the bottom of the drawer or the underside of the side wall of the drawer. In the interior of the running rail, the pullout guide forms rolling surfaces for rolling bodies, which are held in an elongated cage and are capable of rolling along transporting paths of the guiding rails on the one hand and on transporting paths formed by assigned regions of the inner surface of the running rail on the other and thus enable the running rail to be displaced longitudinally relative to the guiding rail.

Because of the plurality of rolling bodies in the form of balls and/or rollers, which can be displaced spatially not only in the pullout direction but also at right angles thereto, drawer pullout guides of the type in question here have the advantage not only of running easily and being able to carry high loads but also of having a high transverse stability when fully pulled out, so that a drawer, supported by means of them in the carcass of a cupboard, wardrobe or cabinet, even when pulled out completely, has no noticeable play in the horizontal transverse direction. For this reason, such pullout guides are used to an increasing extent for supporting drawers in high quality furniture. It is also advantageous in this connection to have the possibility of constructing the hollow profile, used for the running rail, with a low overall height, so that the running rail, in the so-called "subsurface arrangement", can be disposed within the side wall at the underside of the bottom of a drawer directly next to the side wall protruding downwards slightly beyond the bottom, if the side walls of the drawer are formed by hollow metal or plastic profiles, which are open at the underside. By these means, it is possible to enlarge the width of the drawer in comparison to the roller pullout guides, which must be disposed between the outside of the side wall of the drawer and the facing interior side of the supporting wall of the carcass. The cage, which holds the rolling bodies between the guide and the running rail and fixes the mutual distance between them and which is usually constructed from plastic, requires the travel of the pullout guides in question to be limited to a path, which is shorter than the depth of the associated drawer, so that the rear wall of the completely pulled-out drawer is still within the associated carcass of the cupboard, wardrobe or cabinet by the dimensions of the cage, that is, the pullout guides of the type in question here are so-called "partial pullouts". Especially when the drawer is low in height and very deep, the rear region of the drawer, which still lies within the carcass of the cupboard, wardrobe or cabinet in the pulled-out state, can then not be inspected easily and is not very accessible. It would therefore be desirable to construct the pullout guides also so that they can be pulled out completely; the associated drawer could then be pulled so far out of the carcass of the cupboard, wardrobe or cabinet, that its rear wall is flush with the front surface of the carcass of the cupboard, wardrobe or cabinet. Any such guides of the type under consideration here, which can be pulled out completely and are available, are obtained practically as a combination of two simple pullouts into so-called "double pullouts". For roller pullout guides, for which the overall height is of little importance, because the total height of the side wall of the drawer is available, such "double pullouts" are used on a large scale. On the other hand, in the case of the roller body-supported pullout guides, which are in question here and can be used in subsurface arrangement, "double pullouts" can be used only in special cases, since the vertical overall height in the case of these pullouts is significantly greater, as a result of which the side walls of the drawer must protrude more or the bottom of the drawer must be raised in relation to the height, at which it is disposed in the side wall, if the arrangement of running rails is not to be visible in an undesirable manner at the underside of the drawer. With that, however, the capacity of the drawer is decreased.

In those cases, in which the capacity of the drawer is not as critical, attempts were also made with simple pullouts to attain the appearance of a complete pullout, in that the drawer was shortened in the pullout direction approximately by the dimensions of the cage, whereas a running rail of the largest length possible was used. The end regions of the running rails, pointing to the rear wall of the carcass, thus protrude beyond the rear wall of the drawer into the interior of the carcass. Since the protruding ends of the running rail are covered by the rear wall of the drawer, this is not noticeable for drawers supported in the carcass of the cupboard, wardrobe or cabinet. However, the capacity of the drawers is, of course, decreased in proportion to the decrease in depth.

It was proposed for roller pullout guides that a complete pullout could be realized owing to the fact that, instead of inserting a further intermediate rail in the rear end of the running rail, an additional running rail part, which can be tilted about a vertical or horizontal axis, be added. As the drawer is pushed in and approaches the completely closed position, this additional running rail part is swiveled by a forced control about the horizontal axis in the upward direction or about the vertical axis towards the inside in front of the rear wall of the drawer in such a manner, that the drawer can be pushed in further. When the drawer is being pulled out, the running rail part, then aligned once again with the actual running rail, makes available an additional pullout path, which permits the drawer to be pulled out completely (German Offenlegungsschrift 2946113). Such complete pullouts for roller pullout guides have not gained acceptance in practice and, for the subsurface pullout guide under consideration here with pullout guides, constructed as hollow profiles, being supported by roller bodies, complete pullouts have become known only in the form of the aforementioned "double pullouts".

Against this background, it is an object of the invention to develop the subsurface pullout guides, which are under consideration here and the running rail of which is supported on rolling bodies on the guiding rail, further into a complete pullout, without causing an increase in the overall height in the vertical direction.

Starting out from a pullout guide of the type mentioned above, this object is accomplished pursuant to the invention owing to the fact that, at the end of the running rail within the carcass, a hollow profiled section, identical in cross section with the hollow profiled cross section of the running rail, is hinged so that it can be swiveled in a known manner from a first position, in which it is aligned with the running rail and which adjoins its end in the carcass directly, into a second position, which extends, on the other hand, essentially parallel to the rear wall of the drawer and that, at the guiding rail and the pivotable hollow profiled section, interacting guiding means are provided, which swivel the hollow profiled section during the shifting of the running rail on the guiding rail from the end position, assigned to the completely pulled out position of the drawer, in the direction in which the drawer is pushed in, as its end within the carcass approaches the rear wall of the carcass, increasingly into the second position, which is essentially parallel to the rear wall of the drawer. Surprisingly, it has turned out that the pivotable hinging of the hollow profiled section at the rear end of the running rail, formed by a hollow profile of identical cross section, can be carried out with a sufficient accuracy, so that obstructions or stoppages do not occur even when the cage, containing the rolling bodies, passes over the interface between the hollow profiled section and the running rail. On the other hand, an additional pullout path is actually made available in this manner in the length of the hollow profiled section and enables even comparatively deep drawers, the rear wall of which, in the completely pushed in position, is taken almost to the rear wall of the carcass, to be pulled out to such an extent, so as to compensate for the loss in pullout path caused by the cage, containing the rolling bodies.

The swiveling axis of the hollow profiled rail at the running rail can either extend horizontally or also vertically in each case at right angles to the shifting direction of the running rail on the guiding rail, the hollow profiled section, mentioned in the first case, preferably being hinged so that it can swivel from the position, aligned with the running rail, into a position, in which it is swiveled up relative to the aligned position, while in the second case there is swiveling away from the adjacent side wall of the carcass in front of the rear wall of an associated drawer.

To control the swiveling process of the hollow profiled section in a preferred further development of the invention, a control section, pointing from the longitudinal extent of the profiled rail in the swiveling direction of the hollow profiled section, is joined to the end of the profiled rail, which is located at the rear wall of the carcass, and forms the guiding rail, the guiding means then having a control element, which is provided at the hollow profiled section, and engages the control section upon approaching the closing action of the drawer.

Moreover, the embodiment may advantageously be such that the control section adjoins a longitudinal guide, which is provided at the guiding rail and engages the control element.

If the hollow profiled section is hinged to the end of the running rail within the carcass in such a manner that it can be swiveled about a horizontal axis, the longitudinal guide advisably is formed by a strip of material, which protrudes essentially at right angles into the interior of the carcass from a profiled leg of the profiled rail, including the control section, which forms the guiding rail, and lies against and can be fastened to the carcass wall, and the control element is formed by a projection, protruding from the hollow profiled section in the direction of the guiding rail and held at least against one side of the material strip.

On the other hand, if the hollow profiled section is hinged so that it can be swiveled about a vertical axis, the design advisably is such that the longitudinal guide is formed by a strip-shaped region of material of at least one of the profiled legs of the profiled rail forming the guiding rail, which profiled leg or legs is or are reduced in height in their end region within the carcass and transformed out of their course, parallel to the carcass wall, in the direction of the course of the control section, and that the control element is formed by at least one projection, which protrudes from the hollow profiled section to the guiding rail and is held in contact with at least at one side of the strip-shaped region or regions of material.

Moreover, the control element can also be formed by two projections lying against opposite sides of the strip of material, as a result of which a forced control of the swiveling process of the hollow profiled section is then produced.

In any case, it is advisable to provide the projection or projections, at least in the region of its or their contact with the strip of material, with a friction-reducing surface, for example, a suitable plastic coating, in order to avoid binding when the drawer is pulled out or pushed in.

For this purpose, the embodiment can also be such that the projection or projections is or are formed in each case by a control roller, which is rotatably mounted at the hollow profiled section and the peripheral surface of which rolls along one side of the strip of material.

Particularly when the control element is formed by only one projection, held in contact with one side of the strip of material, it is advisable to put the hollow profiled section elastically under tension in the direction of a swiveling motion from the first into the second position. This putting under tension brings about not only the contact between the control element and the strip of material, but at the same time also, if the tension on the spring used is adequate, causes the drawer, on approaching the closed position, to be pulled under the action of the spring into the completely closed position by the hollow profiled section swiveling with respect to the running rail. This means that the function of automatically pulling in the drawer can be realized without additional structural expense.

Because of the fact that the drawer, supported with the inventive pullout guides in a carcass of a cupboard, wardrobe or cabinet, can be pulled further out of the carcass of cupboard, wardrobe or cabinet than it can usually with a conventional pull-out, the bending stress on the rails of the pull-out guides is also increased in the completely pulled-out state, in which the overlap of the running and guiding rails, after all, corresponds essentially only to the length of the cage of the rolling bodies. It is therefore advisable to provide at the end of the guiding rail outside of the carcass at least one projection, which supports the running rail in the completely pulled-out position of the drawer and thus, in addition to the rolling bodies provided at the end of the cage averted from the rear wall, transfers the stresses, arising in the completely pulled-out position of the drawer, to the guiding rail. Here also, it may then once again be advisable if the projection or projections is or are provided at least in the region supporting the running rail with a friction-reducing surface, it also being possible for the projection to be formed by a roller, which is mounted rotatably at a profiled leg of the guiding rail guided into the interior of the running rail and rolls along the inside of the cross member section of the hollow profiled forming the running rail.

In order to make it impossible for the drawer, together with the running rail, to be pulled out of the carcass further than intended, it is advisable to provide a stop for the control element at the end of the strip of material, which is averted from the rear wall of the carcass and forms the longitudinal guide, with which stop the control element collides in the intended pullout position.

If the control element is formed by a control roller, the stop can be formed by an end section of the strip of material bent circularly to correspond to the radius of the control roller.

It is possible to do without the spring, which places the hollow profiled section elastically under tension in the direction of a swiveling into the second position, if this swiveling into the closed position takes place necessarily due to the appropriate construction of the control section. According to a further advantageous development of the invention, this can be attained owing to the fact that a control curve is formed between two boundary walls, which protrude towards the hollow profiled section and between which the control element is accommodated and guided suitably.

In this case also, the control element is advisably constructed as a control roller, which is mounted so that it can rotate at the hollow profiled section and the diameter of which essentially is equal to the distance between the mutually facing surfaces of the control curve boundary walls.

In this connection, it is advisable to make the height of the mutually facing surfaces of the control curve boundary walls the same as or slightly larger than the width of the peripheral region of the control roller that is accommodated between these surfaces and to have short strips of material, which embrace the peripheral region of the control roller somewhat on the hollow profiled section side, protrude from the edges of the boundary walls, facing the hollow profiled rail section, as a result of which the unintentional exit of the control roller from the control curve is precluded reliably.

In this case, the control section advisably is constructed as a flat plastic component, which is provided at the end of the guiding rail within the carcass, manufactured separately and fastened to the guiding rail.

Moreover, the control section preferably is produced from a thermoplastic synthetic material, from the side of which, facing the guiding rail profiled leg provided for fastening the guiding rail to the supporting wall of the carcass, short, integrally joined fastening pins protrude, which reach through boreholes in the profiled leg and are transformed at their free ends by thermoforming into rivet heads.

BRIEF DESCRIPTION OF THE DRAWINGS

The invention is described in greater detail in the following description of an example and in conjunction with the drawings, in which.

DESCRIPTION OF THE PREFERRED EMBODIMENTS

Figures 1, 2, 3, 4, 5:
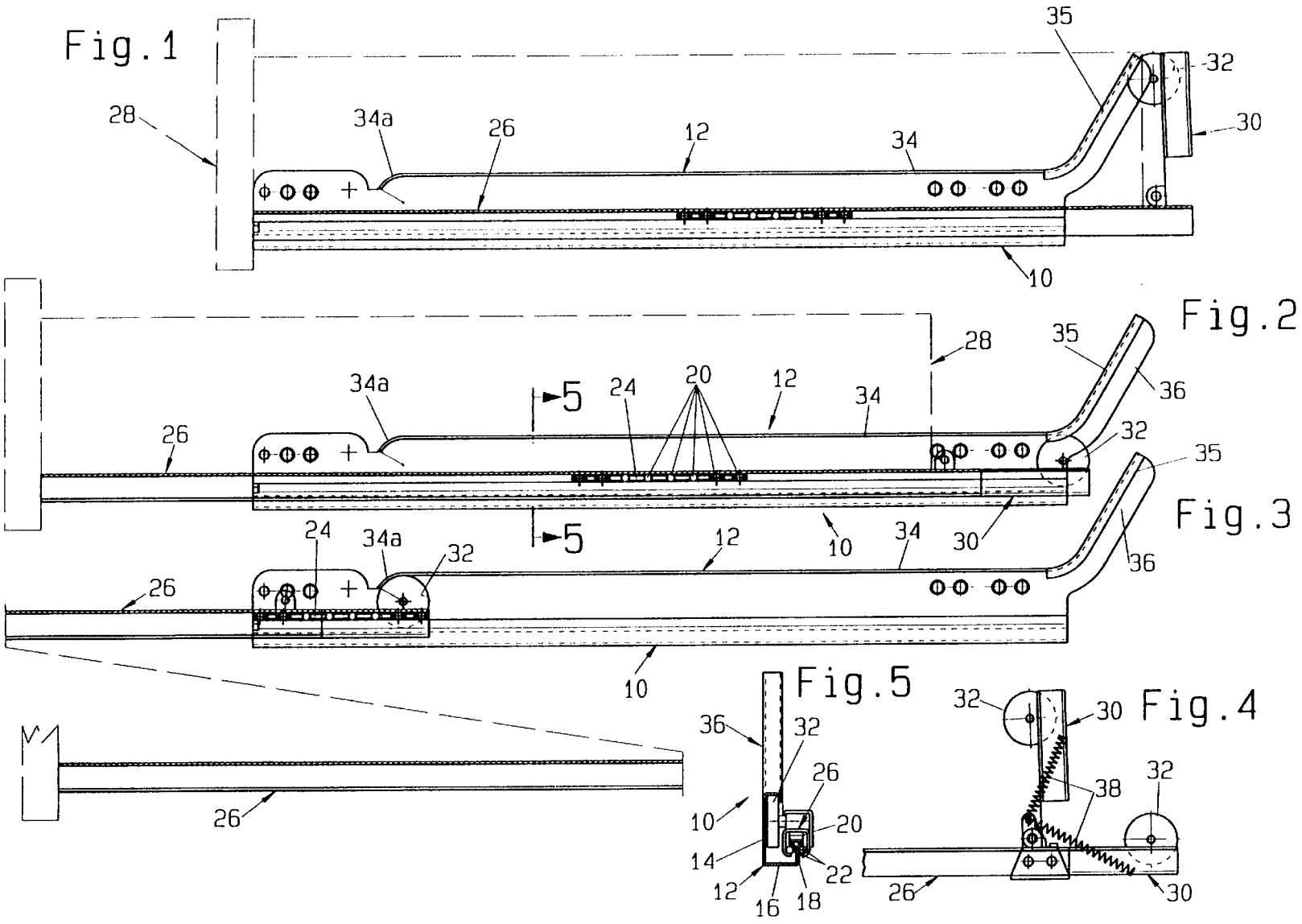
FIG. 1 shows an example of an inventive pullout guide in diagrammatic representation in the position of the running rail on the guiding rail corresponding to the state, in which the drawer is pushed completely into the carcass of a cupboard, wardrobe or cabinet.
FIG. 2 shows a view, corresponding to that of FIG. 1, of a partially pulled out position of the running rail.
FIG. 3 shows a view of the pullout guide, corresponding to that of FIGS. 1 and 2, of the completely pulled-out position of the running rail.
FIG. 4 shows a side view of the rear end of the running rail, in which the pivotably hinged hollow profiled section is shown in both possible end positions, into which it can swivel.
FIG. 5 shows a sectional view, seen in the direction 5—5 in FIG. 2.

FIGS. 1 to 3 show an example, labeled 10 as a whole, of a subsurface pullout guide, constructed pursuant to the invention, in three different positions, namely a position of the running rail on the guiding rail corresponding to the closed position of the drawer, one corresponding to a partially pulled-out drawer and one corresponding to the completely pulled-out drawer, the outline of an associated drawer being indicated in FIGS. 1 and 2 by a broken line.

The construction 10 has a sheet metal guiding rail 12, which is bent into a gutter-shaped profile and the one, perpendicular, profiled leg 14 of which can be fastened at the inner surface (not shown) of the side wall of the carcass of a cupboard, wardrobe or cabinet, preferably by screws. An extended, strip-shaped cross member section 16 is bent approximately at right angles to the lower edge of the profiled leg 14. A further profiled leg 18 is bent upward from the edge of the cross member section 16 averted from the profiled leg 14. The height of this profiled leg 18, measured in the vertical direction, is clearly less than the height of the profiled leg 14. By transforming the sheet metal, tracks for the rolling bodies are formed at the upper free edge of the profiled leg 18 and, moreover, with rollers 20 having a horizontally disposed axis and, on opposite sides to the rollers 20, downwardly offset balls 20, which are held so that they can rotate in a cage 24 at a given distance from and in a specified position relative to one another. The running rail 26, which is constructed as a hollow profiled rail with the cross section of an inverted U, is supported on the rolling bodies so that it can be shifted longitudinally. In the present case, said running rail 26 is intended to be installed at the underside of the bottom of a drawer 28 directly next to the side wall of the drawer assigned to protrude below the bottom of the drawer. If the side wall of the drawer is formed by a hollow metal frame, which is open at the lower front side, the running rail 26 can also be inserted in the open underside of this metal frame. To the extent in which it has been described up to now, the pullout guide is identical with the known pullout guides of the same type.

In an inventive further development, a hollow profiled section is hinged to the end of the running rail within the carcass so that it can be swiveled about an axis extending horizontally at right angles to the direction, in which the drawer is pushed in. The cross section of this hollow profiled section 28 is identical with that of the hollow profile forming the running rail. The hollow profiled section 30 is hinged to the end of the running rail within the carcass in such a manner, that it can be swiveled between the two end positions shown in FIG. 4, namely a first end position aligned against the end of the running rail 26 (see also FIGS. 2 and 3) and a second end position swiveled upward through about 90° relative to the first end position (see also FIG. 1). Since the hollow profiled section 30 is joined to the end of the running rail 26 grasping the drawer from below over the whole length of the drawer, it protrudes full length from the rear wall of the drawer 28 in the first end position. The swiveled position of the hollow profiled section 30 is controlled, in a manner that will still be described in the following, so that it is kept over the greater part of the pushing in and pulling out path of an associated drawer in the first end position, in which also the cage 24, holding the rolling bodies 20, 22, can pass over at least partly from the running rail 28 into the hollow profiled section 30 and vice-versa. Only when the drawer approaches the rear wall of the associated carcass of the cupboard, wardrobe or cabinet (not shown) to such a degree, that the free end of the hollow profiled section 30 threatens to collide with the rear wall, is the hollow profiled section 30 swiveled upward into the second end position. The cage 24, holding the rolling bodies 20, 22, is then completely in the running rail and does not interfere with this swiveling process.

In the vicinity of the free end of the hollow profiled section 30, a control element is provided in the form of a control roller 32, which can be rotated about an axis running parallel to the swiveling axis of the hollow profiled section 30. The peripheral surface of the control roller 32 is pressed against a longitudinal guide, which is provided in the upper edge region of the guiding rail 12 and is in the form of a strip of material 34 cut integrally at the leg 14 of the guiding rail 12 and bent over at right angles into the interior of the carcass and which is able to roll. A control section 36, connecting from the longitudinal extent of the guiding rail 12 obliquely in the swiveling direction of the hollow profiled section, is joined integrally to the carcass rear wall end of the profiled rail, forming the guiding rail 12. The material strip 34 continues in this oblique control section 36, and is rounded off in the transition region between its horizontal extent at the leg 14 and the oblique extent of the control section 36. In the region of the control section 36, the material strip 34 is so wide, that it covers the peripheral surface of the control roller 32 completely. At the free boundary edge of the material strip 34, that is, the edge averted from the profiled leg 14, a narrow strip-shaped, rectangularly bent section 35 of material is joined, which embraces the control roller 32 laterally and thus ensures that the control roller cannot slide laterally from the material strip and become jammed.

FIG. 4 shows that, at the hollow profiled section 30 on the one hand and at the rear end of the running rail 26 in the vicinity of the swiveling axis of the hollow profiled section, a spiral spring 38 is disposed, which is under tension and normally forces the hollow profiled section 30 into the second end position, that is, the position in which it is swiveled up and, at the same time, pushes the control roller 32 against the underside of the strip 34 of material. In the completely pushed-in position of the drawer, the periphery of the control roller 32 thus lies at the outer upper end of the strip 34 of material, which protrudes from the control section 36. If the drawer is then pulled out, the control roller 32 rolls along the strip of material and the hollow profiled section 30 is swiveled increasingly in the direction of the first end position, which is then reached when the control roller crosses over onto the horizontal section of the strip 34 of material. In the region in which the control roller 32 is in the completely pulled-out position of the drawer, the strip 34 of material is bent downward at 34*a* with an arc corresponding to the radius of the control roller 32, as a result of which this end section 34*a* forms a stop, beyond which the running rail 26 with the attached hollow profiled section 30 cannot be pulled out unintentionally. In this end position, the control roller 32 also supports the weight of the drawer and the contents of the drawer over the strip 34 of material at the guiding rail 12. Moreover, it may be advisable to provide an additional support between the running rail and the guiding rail in this front end region by additionally having a projection, provided at the guiding rail 12, support the guiding rail from below in the fully pulled out position. By these means, the stress on the rolling bodies 20, 22 in the completely pulled out position is relieved.

The spring 38 described above not only controls the swiveling process of the hollow profiled section 30 as the drawer 28 approaches the closed position, but also causes the force of the spring, which is supported over the control roller 32 at the strip 34 of material, to exert a torque, which acts in the pulling-in direction of the drawer. In other words, the spring 38 simultaneously realizes the function of automatically pulling in the drawer.

In FIG. 3, it can be seen that, in the completely pulled-out end position, the cage 24, which holds the rolling bodies 20, 22, still protrudes from the rear end of the running rail 26 into the hollow profiled section 30. Particularly when the upper rolling bodies, which transfer the weight of the drawer over the running rail 26 onto the guiding rail 12, are constructed in the manner described as rollers 20, it is advisable to have the junction plane, formed between the adjoining rear end edges of the running rail and the front end edges of the hollow profiled section when the running rail 26 and the hollow profiled section 30 are aligned with one another, extend not at right angles to the pulling-out direction of the running rails, but slightly obliquely to this direction, as seen in plan view, so that the rollers 20, guided in the cage 24 at right angles to the pulling-out direction, roll through the junction plane obliquely, which leads to a soft, continuous transfer of the rollers 20 from the running rail 26 to the hollow profiled section 30 and vice versa, which does not become noticeable in the form of stoppages or rattling noises.

Figure 6:
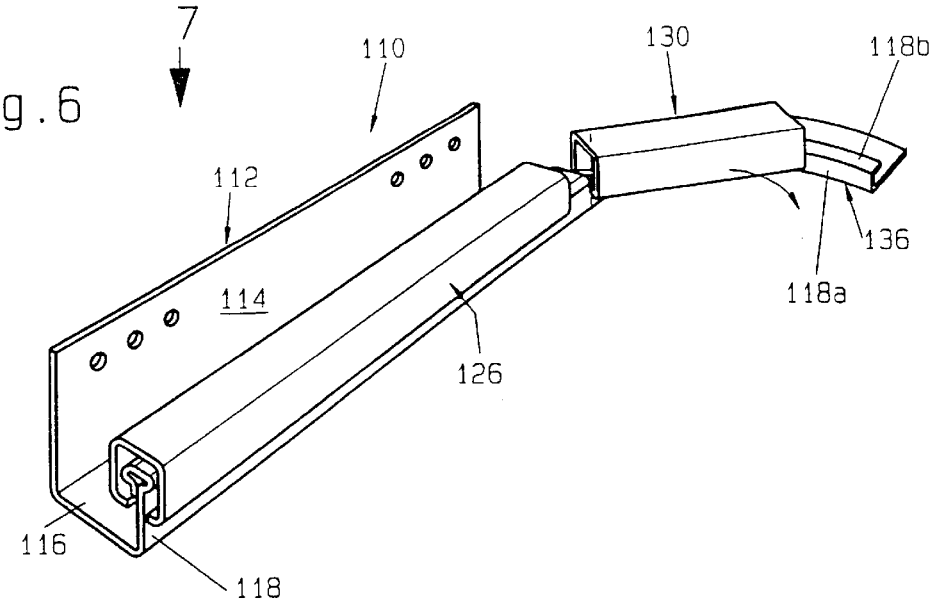
FIG. 6 shows a perspective view of a second embodiment of an inventive pullout guide.
Figure 7:
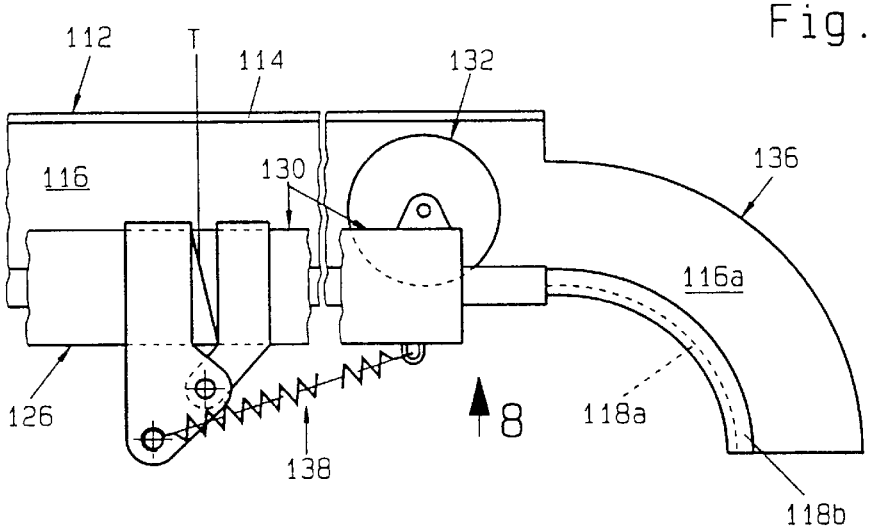
FIG. 7 shows a view of a partial section of the second example, seen in the direction 7 in FIG. 6.
Figure 8:
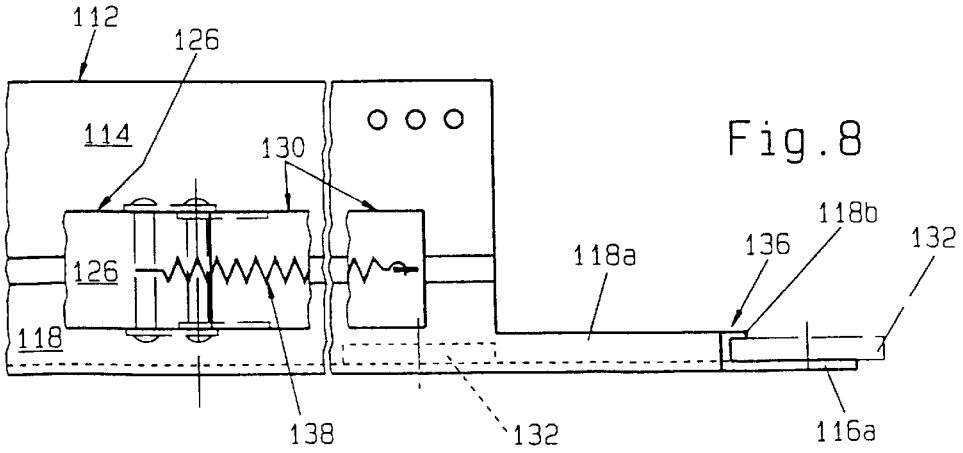
FIG. 8 shows a view, seen in the direction of arrow 8 in FIG. 7

FIGS. 6 to 8 illustrate a second example of the inventive pullout guide, which is labeled 110 as a whole and largely corresponds to the previously described pull-out guide 10, so that it is sufficient to describe below the changes made. For the identical distinguishing features of the construction, it is sufficient to refer to the previous description, particularly since functional identical components of the two examples have been given the same reference numbers in the drawings, which are merely preceded by a "1" in the case of the second example.

The basic difference between the pullout guide 110 and the pullout guide 10 consists therein that the hollow profiled section 130 is disposed at the end of the running rail 126 within the carcass so that it can be swiveled about a vertical axis. The control roller 132, which aligns the hollow profiled section 130 over the gutter part of the pullout and push-in path aligned with the actual running rail 126, is mounted at the rear-wall end of the hollow profiled section so that it can be rotated in such a manner, that its periphery rolls along the inner surface of the profiled leg 118 of the guiding rail 112 pointing towards the profiled leg 114, and moreover beneath the running rail 126, that is, in the region of the profiled leg 118, lying below the running rail 126 and adjoining the cross member section 116 of the guiding rail directly. By the tension on the spring 138, the hollow profiled section 130 is acted upon in the sense of a swiveling away from the profiled leg 114 in such a manner, that the control roller 132 is held against the profiled leg 118.

The control section 136, joined to the end of the guiding rail 112 within the carcass, is joined, corresponding to the vertical arrangement of the swiveling axis of the hollow profiled section 130, to the guiding rail in such a manner, that it controls the desired swiveling of the hollow profiled section in a horizontal plane in front of the rear wall of the drawer. For this purpose, the cross member section 116 of the guiding rail is continued in a section 116*a*, which is continued arc-shaped over about 90° in the swiveling direction and from the one boundary edge of which within the carcass a low, strip-shaped region of material 118*a* protrudes upwards, along which the control roller 132 rolls during the swiveling process of the hollow profiled section 130.

Compared to the profiled leg 118, the strip-shaped region of material 118*a* within the carcass is kept lower in height by such an amount, that the hollow profiled section 130 can swivel above the upper boundary edge of the strip-shaped region of material 118*a* and the end of the actual running rail 126 within the carcass can be pushed over the material regions 118 up into the vicinity of the rear wall of the carcass. At the same time, a narrow, strip-shaped section of material 118*b* once again is bent over from the upper free boundary edge of this material region 118*a* and overlaps the control roller 132 at the upper side and thus takes over the function of the strip-shaped section 35 of material of the pullout guide 10, that is, the control roller 132 is prevented from gliding off the strip-shaped section of material, and a malfunctioning is thus prevented.

FIG. 7 also illustrates the oblique course of the junction plane, which is explained as being advantageous in conjunction with the first example, between the rear end of the running rail 126 and the front end of the hollow profiled section 130, which are aligned with one another, illustrated by the oblique course of the junction line T between these two parts, which can be seen in the Figure.

Figure 9:
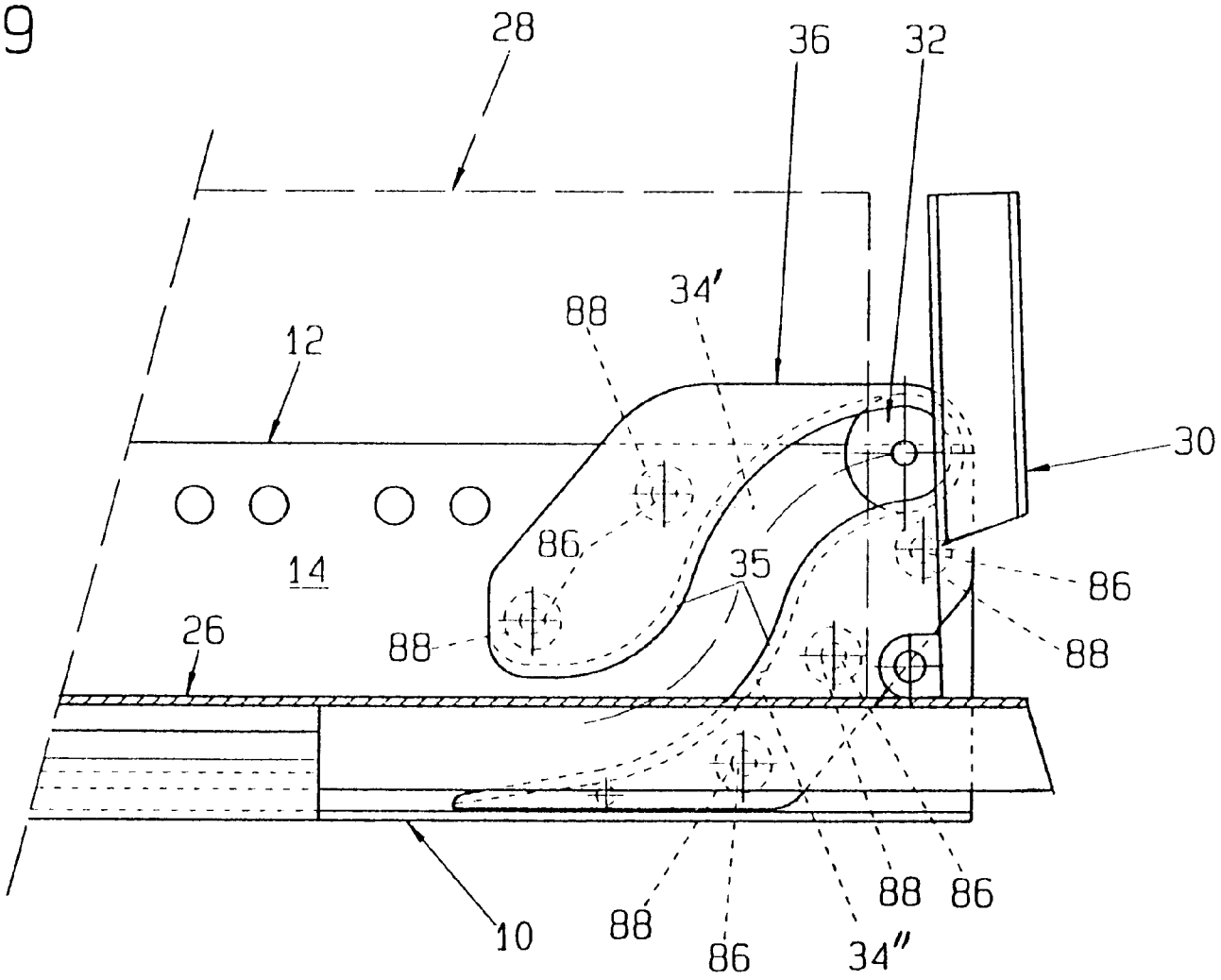
FIG. 9 shows a side view of the end region of a pullout guide within the carcass with a separately manufactured plastic control section, which is fastened to the guiding rail and which brings about an automatic swiveling of the hollow profiled section when the closed position of the drawer is approached.

In FIG. 9, a modification of the first example is shown with a hollow profile, which can be swiveled about a horizontal axis. The modification made relates to the design of the guiding rail 12 in the region of the control section, which is a separately produced flat plastic component 36 here, which is fastened seated on the end region within the carcass of the flat side of the profiled leg 14 of the guiding rail 12 facing the drawer. In the case shown, it is fastened in such a manner that, when the control section 36 is being produced, several projecting plastic pins 86 are gated into the flat side of the control section 36 facing the profiled leg 14 and are passed through boreholes countersunk into the profiled leg 14 on the carcass wall side and then deformed by pressing down an extrusion die, heated above the softening temperature of the plastic material of the control section 35, into the depression with formation of a rivet head 88. Alternatively, other types of fastening, such as riveted connections by means of metallic rivets passing through separate, aligned boreholes in the control section 36 and the profiled leg 14, are also conceivable.

It can also be seen here that the actual control curve, taking up and guiding the control roller 32, is open or closed there only by the profiled leg 14 at the bottom side facing the profiled leg 14. At the periphery, the control roller 32 is guided by the boundary walls 34' 34", between the mutually facing surfaces of which the control roller 32 is guided forcibly and secured against leaving in the direction of the drawer by short, laterally overlapping, strip-shaped sections 35 of material.

Because the control section 36 is produced from plastic, the control roller 32 can also be disposed closer to the pivoting axis of the hollow profiled section 30 at the running rail 26, the control curve then assuming an S-shaped course, which can be recognized in the drawing. It has turned out that it is possible in this way to ensure a continuous and stoppage-free as well as noiseless transfer of the rolling bodies into and out of the hollow profiled section 30.

The spring, which puts the hollow profiled section 30 under tension in the first example in the second, swiveled-up position, is omitted in this example, so that the hollow profiled section 30 is thus guided forcibly in the control curve only as it approaches the closed position of the drawer. In all remaining pulled-out positions of the running rail relative to the guiding rail, the hollow profiled section 30 is held exclusively by its own weight in the position aligned to the running rail. An unintentional swiveling up of the hollow profiled section 30, which could lead to a malfunctioning, nevertheless is not possible because the hollow profiled section, in the position in which the running rail is pulled out completely or partially on the guiding rail during the swiveling up, comes into contact with the converted upper edge of the profiled leg 18 of the guiding rail carrying the transporting paths for the rolling bodies, that is, the hollow profiled section cannot be swiveled further into a stable, swiveled-up position.

Because of the omission of the spring, which would put the hollow profiled section 30 under tension into the second swiveled-up position, the additional function of automatically pulling the drawer into the closed position is omitted in this example. If such an automatic pulling in is desired, it is possible to resort here to known automatic pulling-in devices acting between the guiding rail 12 and the running rail 26.

What is claimed is:

1. A pullout guide for drawers and the like supported in the carcass of a structure comprising:

(a) a guiding rail shaped like a gutter comprising a first vertical side wall which can be fastened to said carcass, a horizontal planar bottom wall perpendicular to said first vertical sidewall, and a second vertical side wall perpendicular to said horizontal planar bottom wall and parallel to said first vertical side wall, wherein said guiding rail is fastened to a wall of said carcass;

(b) a running rail having the shape of an inverted U, comprising a third vertical side wall, a horizontal planar top perpendicular to said third vertical side wall, a fourth vertical side wall perpendicular to said horizontal planar top and parallel to said third vertical side wall, and a cage for containing roller elements for riding on said guiding rail to enable longitudinal displacement of the running rail relative to the guiding rail; and (c) a profiled section hinged to a back end of the running rail by interacting guiding means, said profiled section arranged and constructed to pivot from a first position to a second position, said first position being aligned in the longitudinal direction of the running rail and said second position being substantially perpendicular to said running rail;

said interacting guiding means arranged and constructed to pivot the profiled section from said first position into said second position as said drawer is pushed into said carcass;

wherein the profiled section is constructed and arranged to have an identical cross section as that of the running rail and said profiled section rides on said guiding rail.

2. The pullout guide of claim 1 wherein said second position further comprises the profiled section being substantially vertical.

3. The pullout guide of claim 2 wherein the interacting guiding means further comprises a rolling element and a tension element.

4. The pullout guide of claim 3 wherein the rolling element further comprises a control roller rotatably mounted to the profiled section wherein the peripheral surface of said control roller rolls along said guiding rail.

5. The pullout guide of claim 4 wherein a tensile strength of the tension element is sufficient to pull the drawer into the interior of the carcass once the hollow profiled section begins to swivel from the first to the second position.

6. The pullout guide of claim 5 wherein the tension element further comprises a spring for pulling the profiled section from the first position to the second position.

7. The pullout guide of claim 6 wherein the elements of the interacting guiding means further comprise friction-reducing surfaces over the areas that contact said running rail.

8. The pullout guide of claim 7 wherein at least one element of the interacting guiding means protrudes from the carcass at the end of the guiding rail when the drawer is fully open.

9. The pullout guide of claim 8 wherein a control rail having the same cross-section as said guiding rail extends upwardly from a back end of said guiding rail constructed and arranged so that said rolling element engages the control rail as the drawer is pushed into said carcass and brings the profiled section into said second position.

10. The pullout guide of claim 9 wherein the control rail further comprises a vertical planar member substantially aligned with said first vertical side wall of the guiding rail; and, a lip extending downwardly from the top of said vertical planar member along the length of said member;

whereby the rolling element rides along the control rail as the drawer is pushed into said carcass.

11. The pullout guide of claim 10 wherein the lip further comprises a strip of material protruding at a right angle from a top of said vertical planar member and then downwardly along a length of said member.

12. The pullout guide of claim 11 wherein the strip of material on said guiding rail has a stop for the control roller at a front end.

13. The pullout guide of claim 12 wherein the stop further comprises a circularly bent end section corresponding to a radius of the rolling element.

14. The pullout guide of claim 13 wherein the strip of material contacts the peripheral edge surface of the control roller laterally on both sides of said control roller.

15. The pullout guide of claim 14 wherein a junction plane between the running rail and the profiled section when the hollow profiled section adjoins aligned at the end of the running rail within the carcass, proceeds obliquely, deviating from a course directed at right angles to the displacement direction of the running rail.

16. The pullout guide of claim 3 wherein a control path is defined by a curved interior path in a planar member that is fixed to said carcass at the back end of said guiding rail whereby said control path guides said control roller to bring said profiled section into said first and said second positions.

17. The pullout guide of claim 16 wherein the control roller is mounted so that it can rotate at the hollow profiled section and its diameter is essentially equal to the width of said control path.

18. The pullout guide of claim 16 wherein the width of said path is the same as or slightly larger than the width of the peripheral region of the control roller and in that short strips of material, which somewhat embrace the peripheral region of the control roller on the hollow profiled section side, protrude from the edges of the boundary walls, facing the hollow profiled section.

19. The pullout guide of claim 18 wherein the planar member is a flat, plastic component, which is manufactured separately, provided at the end of the guiding rail within the carcass and is fastened to the guiding rail.

20. The pullout guide of claim 19 wherein the planar member is produced from a thermoplastic synthetic material, from the flat side of which, facing the guiding rail profiled leg provided for fastening the guiding rail to the supporting wall of the carcass, short, integrally joined fastening pins protrude, which reach through boreholes in the profiled leg and are secured against retraction out of the boreholes by thermoforming the free ends of the fastening pins into rivet heads.

21. The pullout guide of claim 1 wherein said second position further comprises the profiled section being substantially horizontal.

22. The pullout guide of claim 21 wherein the interacting guiding means further comprises a rolling element and a tension element positioned on opposite sides of the control rail.

23. The pullout guide of claim 22 wherein the rolling element further comprises a control roller rotatably mounted to the profiled section, wherein the peripheral surface of said control roller rolls along said guiding rail.

24. The pullout guide of claim 23 wherein the tensile strength of the tension element is sufficient to pull the drawer into the interior of the carcass once the hollow profiled section begins to swivel from the first to the second position.

25. The pullout guide of claim 24 wherein the tension element further comprises a spring for pulling the profiled section from the first position to the second position.

26. The pullout guide of claim 25 wherein the elements of the interacting guiding means further comprise friction-reducing surfaces over the areas that contact said running rail.

27. The pullout guide of claim 26 wherein at least one element of the interacting guiding means protrudes from the carcass at the end of the guiding rail when the drawer is fully open.

28. The pullout guide of claim 27 wherein a control rail having the same cross-section as said guiding rail extends horizontally from a back end of said guiding rail constructed and arranged so that said rolling element engages the control rail as the drawer is pushed into said carcass and brings the profiled section into said second position.

29. The pullout guide of claim 28 wherein the control rail further comprises a horizontal planar member; and, a lip extending upwardly from a front of said horizontal planar member along the length of said member;

whereby the rolling element rides along the control rail as the drawer is pushed into said carcass.

30. The pullout guide of claim 29 wherein the lip further comprises a strip of material protruding upwardly at a right angle from the front of said horizontal planar member and then backwardly therefrom along the length of said member.

31. The pullout guide of claim 30 wherein the strip of material has a stop on said guiding rail for the control roller at its front end.

32. The pullout guide of claim 31 wherein the stop further comprises a circularly bent end section corresponding to the radius of the rolling element.

33. The pullout guide of claim 32 wherein the strip of material contacts the peripheral edge surface of the control roller laterally on both sides of said control roller.

34. The pullout guide of claim 33 wherein a junction plane between the running rail and the profiled section when the hollow profiled section adjoins aligned at the end of the running rail within the carcass, proceeds obliquely, deviating from a course directed at right angles to the displacement direction of the running rail.

* * * * *